US009454853B2

(12) United States Patent
Gupta

(10) Patent No.: US 9,454,853 B2
(45) Date of Patent: Sep. 27, 2016

(54) ELECTRONIC SECURITY PATROL COMPLIANCE SYSTEMS AND METHODS FOR INSTITUTIONAL FACILITY

(71) Applicant: Centric Group LLC, St. Louis, MO (US)

(72) Inventor: Atul Gupta, Grimes, IA (US)

(73) Assignee: CENTRIC GROUP LLC, St. Louis, MO (US)

( * ) Notice: Subject to any disclaimer, the term of this patent is extended or adjusted under 35 U.S.C. 154(b) by 150 days.

(21) Appl. No.: 14/202,409

(22) Filed: Mar. 10, 2014

(65) Prior Publication Data

US 2014/0313031 A1 Oct. 23, 2014

Related U.S. Application Data

(60) Provisional application No. 61/780,667, filed on Mar. 13, 2013.

(51) Int. Cl.
*G08B 1/08* (2006.01)
*G07C 1/20* (2006.01)

(52) U.S. Cl.
CPC ..... *G07C 1/20* (2013.01)

(58) Field of Classification Search
CPC ..... A61B 5/1112; G08B 21/0202
USPC ..... 340/539.1, 539.11, 539.13, 506, 3.1, 340/572.1
See application file for complete search history.

(56) References Cited

U.S. PATENT DOCUMENTS 5,400,246 A * 3/1995 Wilson ..... G08B 25/14 340/12.53
5,959,529 A * 9/1999 Kail, IV ..... G01S 19/17 128/903
2006/0232406 A1* 10/2006 Filibeck ..... G08B 13/2462 340/572.1

* cited by examiner

*Primary Examiner* — Daryl Pope
(74) *Attorney, Agent, or Firm* — Armstrong Teasdale LLP

(57) ABSTRACT

Electronic systems for verifying completion of security patrols include primary and secondary identifier elements distributed along a predetermined route of the security patrol. A portable electronic device is configured to confirm an officer's presence at each of the primary and secondary identifier element locations. The primary identifier element is machine readable while the secondary identifier element requires operator input to confirm the location.

46 Claims, 4 Drawing Sheets

ELECTRONIC SECURITY PATROL COMPLIANCE SYSTEMS AND METHODS FOR INSTITUTIONAL FACILITY

CROSS REFERENCE TO RELATED APPLICATIONS

This application claims the benefit of U.S. Provisional Application Ser. No. 61/780,667 filed Mar. 13, 2013, the complete disclosure of which is hereby incorporated by reference in its entirety.

BACKGROUND OF THE INVENTION

The field of the invention relates generally to administrative systems for institutional facilities, and more specifically to an electronic system for evaluating compliance of security patrol procedures for institutional facilities such as correctional facilities.

Various types of institutional facilities are known that house residents in a controlled environment. Such institutional facilities include, for example, correctional facilities such as prisons and jails, hospitals, convalescent homes, long term care facilities, nursing homes, psychiatric facilities, rehabilitation facilities and developmental disability facilities. Such institutional facility environments present security issues that often require security patrols performed by trained persons. Such security patrols are often referred to as "rounds" and are a standard operating procedure in many institutional environments. Each round involves at least one person who typically walks along a path, which may be predetermined, or that may be discretionary to the officer. The path may reside partially or wholly inside or outside one or more structures in the institutional facility. In other cases, at least one person may move wholly or partially along a path with the assistance of a vehicle. Regardless, the round is typically started at a first location, proceeds along a path, and ends at a second location, which may coincide with the starting location. As such, each round generally constitutes a loop, and as the person traverses the path from start to end the conditions along the path are assessed.

In the case of a correctional facility such as a jail or prison, multiple times each day one or officers specifically walks inside and around each building looking for potential damage or maintenance issues associated with the facility, potential escape routes or other alterations being made by inmates, persons that may be out of place or are not in an expected location, contraband, or other issues requiring attention. Ensuring that these rounds are being done timely, consistently and completely has been a perennial challenge to correctional facility administrators. While a number of systems and methods are known to track the completion of rounds in a correctional facility, improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
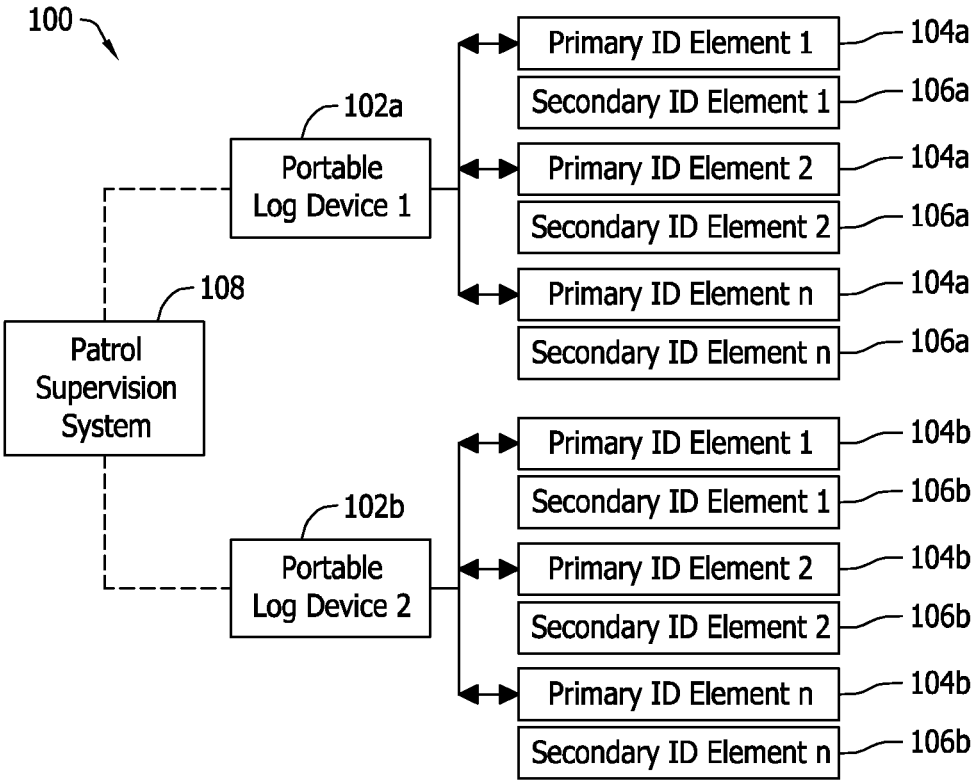
FIG. 1 schematically illustrates an electronic system for verifying compliance in completing security patrol rounds in an institution such as a correctional facility.

Institutional facilities such as correctional facilities have employed various techniques to monitor and ensure completion of officer rounds. Each is lacking in certain aspects.

Conventionally, institutions have employed paper logs for the officers to complete and therefore record the completion of each round. The integrity of such logs, however, depends entirely on the officers that make the entries and/or persons overseeing the paper logs. Not only are paper log entries subject to human error and mistake, they are also vulnerable to deceptive entries by officers that do not actually complete the rounds, but log entries as if they did. Such mistaken and deceptive log entries may go unnoticed indefinitely by facility and administrators, and may potentially compromise the physical security of the correctional facility. Also, because the paper logs include handwritten entries, even if the log is accurate it can be difficult to read and may be misinterpreted. Finally, the paper log is subject to being lost or misplaced, subject to damage via intentional or inadvertent tearing of the pages, and subject to having pages removed or fall out over extended periods of time. Also, an occasional spill of water or coffee can render large portions of a page or pages in the log illegible or unusable.

As an alternative to paper logs, electronic systems including special locks and/or sockets have sometimes been placed at a plurality of different locations along portions of each path or corridor that officers are to patrol in making a round. When an officer arrives at each lock or socket, they can interact with it to prove that they were physically at the particular location of the lock or socket. For example, officers may unlock the lock or insert a wand into the socket, and in each case the officer's action is electronically logged as a record that an officer was at the required location. The electronic logs associated with locks and sockets are stored locally at each location, and while the various logs of locks and sockets may be compiled to create records of entire rounds, reconciling the logs from such devices at various locations to confirm the rounds one at a time is tedious and time consuming Such lock and socket systems are also an ongoing maintenance concern, especially for larger facilities having relatively large numbers of the locks and keys that are independently operable. Errors or failures of any of the locks or sockets, both mechanically and in creating the electronic logs, may introduce severe complications in reconciling the electronic logs to ensure that rounds have been completed. Any missed log entries or false log entries attributable to malfunctioning locks or sockets can create discrepancies in the electronic records that are not easily or quickly resolved.

Such lock or socket systems are also subject to being manipulated by unscrupulous persons because, while they can detect the presence of a person at the respective locations of the locks or sockets when the locks or sockets are manipulated, they lack any ability to know which person activated the lock or key. This renders these types of systems vulnerable to a group of officers, a group of other persons, or a group of officers and other persons, to trick the system. Specifically, a group of persons can make it appear that the rounds were completed by having different persons activate the locks or sockets at different locations. Such manipulation is difficult to detect and may occur for some time without being noticed by facility administrators.

Camera surveillance can confirm that specific officers complete entire rounds of patrol, but camera surveillance is an expensive and impractical solution in most cases. Multiple cameras are required and the recorded footage must typically be stored and reviewed to ensure actual completion of the rounds. In a large facility having multiple rounds completed multiple times a day by a plurality of officers, recording and reviewing surveillance video just to ensure completion of rounds can itself be an enormous task. Live monitoring of surveillance video is an option for some facilities, but not all facilities. Also, surveillance monitoring of officers, as opposed to inmates and others in the facility, is perhaps not the best use of camera surveillance systems. Whether surveillance footage is monitored live or not, such monitoring is dependent on the integrity of those monitoring the surveillance footage. An inattentive monitor, or an unscrupulous one, can render camera surveillance practically worthless.

Exemplary embodiments of electronic compliance and verification systems are disclosed hereinbelow that avoid these and other problems in the art. The electronic systems are simpler than conventional verification systems in many ways, and hence may be provided at lower cost than conventional verification systems. Advantageously, the electronic systems described below are less susceptible to deceptive use and manipulation, and operate in an automated manner that reduces administrative effort and oversight to manage security patrols. Method aspects will be in part apparent and in part explicitly discussed in the description below.

While described in the context of a correctional facility such as a prison or jail, it is understood that other institutional environments may likewise benefit from the systems and methods described below. That is, the systems and methods described herein are not necessarily limited to correctional facility applications. Rather, an institution wherein regular security patrols are preferred along predetermined routes may benefit from the electronic compliance and verification systems and methods described.

As shown in FIG. 1, the electronic system 100 includes a plurality of portable electronic devices, referred to herein as portable log devices 102, each respectively communicating with a plurality of primary electronic identifier elements 104 and also a plurality of secondary identifier elements 106 that, in combination, ensure that a person on patrol is actually completing a patrol by traversing the entire route or path associated with a round. The primary electronic identifier elements 104 may electronically communicate with the portable log devices 102, and the secondary identifier elements 106 provide a manual check that requires operator input in order for the portable log devices 102 to log an entry as evidence that a person on patrol has actually visited a location along the patrol route.

Each of the portable log devices 102 and the associated primary and secondary electronic identifier elements 104, 106 may be associated with one of a plurality of respective paths or routes for a patrol round. As such, in the example of FIG. 1, the portable log device 102*a* is associated with primary and secondary identifier elements 104*a*, 106*a* along a first predetermined route. The system 100 may generally accommodate any number n of primary and secondary electronic identifier elements 104*a*, 106*a* communicating with the portable log device 102*a* as described below.

The portable log device 102*b* is associated with primary and secondary identifier elements 104*b*, 106*b* along a second predetermined route. The system 100 may generally accommodate any number n of primary and secondary identifier elements 104*b*, 106*b* communicating with the portable log device 102*b* as described below. The number n of primary and secondary electronic identifier elements 104*a*, 106*a* communicating with the first portable log device 102*a* and the number n of elements 104*b*, 106*b* communicating with the second portable log device 102*b* need not be the same in any given implementation of the system 100. Additionally, while two portable log devices 102*a*, 102*b* are shown in the example of FIG. 1, additional portable log devices 102 and additional primary and secondary identifier elements 104, 106 may be provided to accommodate additional predetermined routes for patrol.

Different persons, including officers in the case of a correctional facility environment, carrying the portable log devices 102*a*, 102*b* may therefore complete different patrol routes, with the respective primary and secondary electronic identifiers 104*a*, 104*b* and 106*a*, 106*b* confirming that the person (e.g., a correctional facility officer) visits each location along the respective routes. In certain contemplated embodiments, the portable log devices 102*a*, 102*b* and the primary and secondary identifier elements 104*a*, 106*a* and 104*b*, 106*b* may be uniquely configured for each path or route that defines a round of a patrol route. In another embodiment, each of the portable log devices 102*a*, 102*b* and their respective primary and secondary electronic identifier elements 104*a*, 106*a* and 104*b*, 106*b* may be substantially identical to one another such that the portable electronic devices 102*a*, 102*b* may be universally used with any of the identifier elements 104*a*, 106*a*, 104*b*, 106*b* provided. That is, in some embodiments of the system 100, either of the log devices 102*a*, 102*b* may communicate with either of the sets of primary and secondary identifier elements 104*a*, 106*a* and 104*b*, 106*b*. Thus, in such embodiments a single person (e.g., correctional facility officer) having one of the portable log devices 102 may make a round on different patrol routes, with the system 100 confirming the completion of each patrol route. Compliance issues for route completion by the same or different officers can be assessed by the system 100 as explained below.

As also shown in FIG. 1, each of the portable electronic devices 102*a*, 102*b* may further communicate with a patrol supervision system 108 in real-time as the system 100 operates, or alternatively at a time of an officer's choosing. The portable log devices 102*a*, 102*b* may communicate with the patrol supervision system 108 at a remote location via wireless or non-wireless communication techniques. In contemplated embodiments, the patrol supervision system 108 may be located in an administrator's station in the facility, or may alternatively communicate with a computer device at the administrator's station or elsewhere in the facility.

Figure 2:
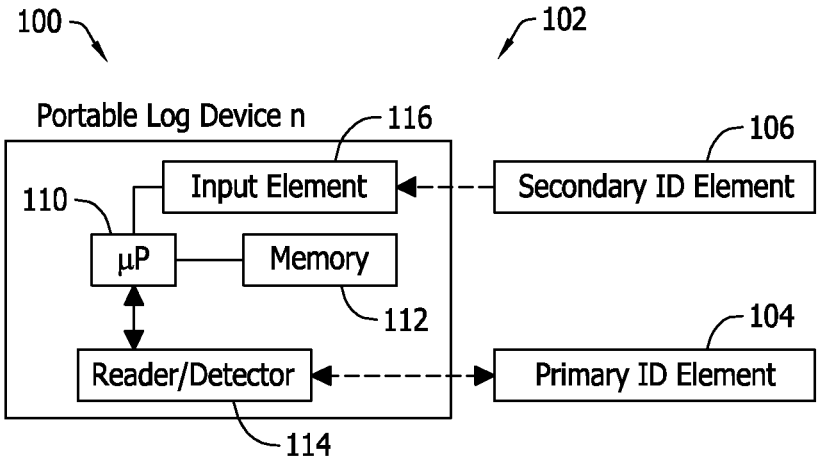
FIG. 2 schematically illustrates a portable electronic device for the system shown in FIG. 1 and a primary and secondary electronic identifiers for the system shown in FIG. 1.

FIG. 2 illustrates an exemplary portable log device 102 and exemplary primary and secondary electronic identifier elements 104 and 106. In the example shown, the portable log device 102 may be a processor-based device including a processor 110 and a memory 112 for storing instructions, control algorithms and other information as required for system 100 to function in the manner described. The memory 112 may be, for example, a random access memory (RAM), or other forms of memory used in conjunction with RAM memory, including but not limited to flash memory (FLASH), programmable read only memory (PROM), and electronically erasable programmable read only memory (EEPROM). Alternatively, non-processor based electronics and circuitry may be provided in the device 102 with equal effect to serve similar objectives.

As used herein, the term "processor-based device" shall refer to devices including a processor or microprocessor as described for controlling the functionality of the device 102, but also other equivalent elements such as, microcontrollers, microcomputers, programmable logic controllers, reduced instruction set (RISC) circuits, application specific integrated circuits and other programmable circuits, logic circuits, equivalents thereof, and any other circuit or processor capable of executing the functions described below. The processor-based devices listed above are exemplary only, and are thus not intended to limit in any way the definition and/or meaning of the term "processor-based device."

The portable log device 102 may also include a reader/detector element 114 and an input element 116. The reader/detector element 114 communicates with the primary electronic identifiers 104 and the input element 116 accepts an operator-provided input associated with the secondary identifier elements 106 as explained below.

Figure 3:
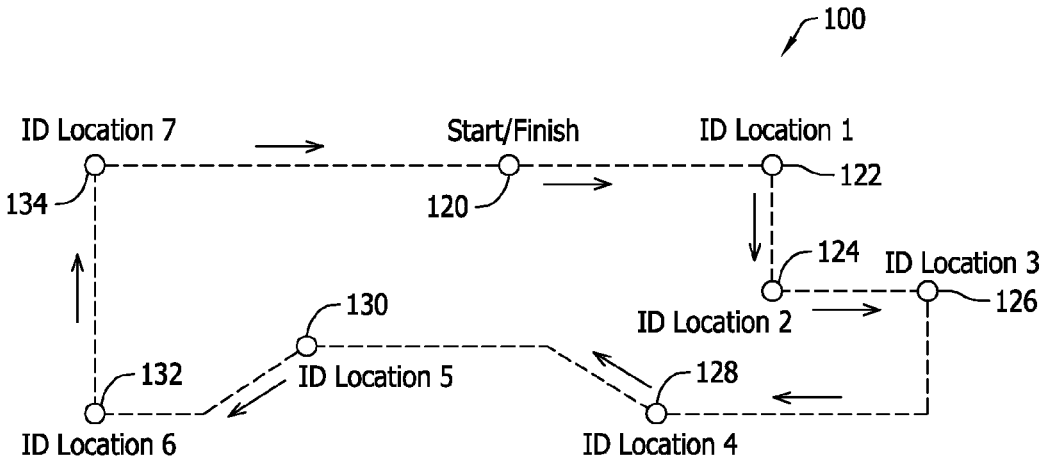
FIG. 3 schematically illustrates an exemplary security patrol route including electronic identifier locations arranged along the route.

In the system 100, and as further illustrated in FIG. 3, the primary and secondary electronic identifiers 104, 106 are arranged in pairs at specific, predetermined locations 120, 122, 124, 126, 128, 130, 132 and 134 along a security patrol path or route 136 corresponding to a round of a patrol route. As illustrated in FIG. 3, a person (e.g., a correctional facility officer) begins at the start location 120 (Location 0) and proceeds to location 122 (Location 1), proceeds from Location 1 to location 124 (Location 2), proceeds from Location 2 to location 126 (Location 3), proceeds from Location 3 to location 128 (Location 4), proceeds from Location 4 to location 130 (Location 5), proceeds from Location 5 to location 132 (Location 6), proceeds from Location 6 to location 134 (Location 7), and proceeds from Location 7 to the finish location, which in the illustrated example coincides with the start location 120 (Location 0). At each of the Locations 0-7 in the route, the officer utilizes the electronic device 102 to read the primary identification element 104 and confirm with the secondary identification element 106 that each of the designated Locations 0-7 on the route 136 has been visited.

While in the example of FIG. 3, the route 136 proceeds along a predetermined path wherein the designated Locations 0-7 are to be visited in the order shown and described, this is not required in all embodiments. For example, and if desired, the route 36 may be traversed by a person in the opposite direction to that described. That is, a person may instead start at location 0 and proceed to Location 7, then Location 6, then Location 5, then Location 4, then Location 3, then Location 2, then Location 1, and back to Location 0. As such, the route 136 may be completed backward or forward without impacting the operation of the system 100.

Importantly, it is not necessarily required in all cases that the path 136 be predetermined in for the system 100 to work. That is, in some contemplated embodiments, a person (e.g., a correctional facility officer) may walk along any path desired within the facility, and may visit the designated Locations 0-7 in any order. As one example of this using the route 136 shown in FIG. 3, a person may start at Location 0, proceed directly to Location 5, then to Location 7, then to Location 6, then to Location 4, then to Location 2, then to Location 3, and back to Location 0. Likewise, any of the Locations 0-7 may be deemed a start or finish location for completion of the round 136. In such a scenario, the order of the designated Locations 0-7 visited is not important and the system 100 serves to simply verify that all of the designated Locations 0-7 have been visited. Indeed, in such non-predetermined route scenarios it may be perhaps more likely that one of the designated Locations 0-7 may be inadvertently missed by the person on patrol, and if so the system 100 reliably tracks the visited designated Locations 0-7 and provides notification of any missed designated locations. In such non-predetermined route scenarios, the important thing to assess is that all of the designated Locations 0-7 are visited, and not necessarily the order that the designated Locations 0-7 are visited.

While an exemplary route 136 is shown having a certain number of designated Locations 0-7, in general, a patrol route may have any number n of designated locations for purposes of the system 100. Various routes of varying length may be provided for patrol by the same or different officers. In different embodiments, the patrol routes may be entirely inside, entirely outside, partly inside and partly outside, and may involve different structures of the correctional facility or other institutional facility. Additionally, patrol routes may be walked by an officer or completed, in part or in whole, with assistance of a vehicle.

Patrols along the route 136 may further be completed by a single person or a group of persons. In the example of a correctional facility, when the route 136 is completed by a group of officers, each officer may carry one of the portable log devices 102 or only of the officers may be provided with the log device 102 to confirm the traversal of the entire route 136 by the system 100.

In further implementations, and again in the example of a correctional facility, it may be possible for one officer to complete a first portion of the route 136 and a second officer to complete a second portion of the route 136. In such scenarios, a single log device 102 may be passed from officer to officer like a baton with the completion of the entire route 136 confirmed with one log device 102. In another scenario, different log devices 102 could be utilized by each officer, with each log device 102 confirming designated portions of the patrol route 136.

The log devices 102 may be configured as user-based devices such that an officer using one of the devices 102 logs on to the device 102 so that the system 100 may identify the particular officer using any one of the devices 102 and portions of the route 136 (or other routes in the system 100) completed by that officer. When the officer is done with the log device 102, the officer may log off the device 102 and make it available for another officer to log in and complete all or a portion of a patrol route. As such, multiple officers may use the same log device 102 with the system still being able to differentiate officers completing the patrol routes and visiting the designated Locations 0-7 in the example of FIG. 3. Auditing of the system data by individual user may therefore be facilitated by having each device 102 identified with a specific officer at all times during use.

Each electronic identifier element 104 at each designated Location 0-7 in the patrol route 136 may be scanned, detected, or otherwise communicate with the electronic device 102, preferably in a non-contact manner so that the portable electronic device 102 may identify its location on the route 136. In one embodiment, the primary electronic identifier 104 at each location is a passive, machine readable element in the form of a unique two-dimensional barcode that may be read by the detector element 114 (FIG. 2) of the device 102, with the bar code relating to or identifying its specific location in the route.

In another embodiment, other types of machine readable elements, including but not limited to elements such as radio frequency identification (RFID) elements, may be utilized in combination with a compatible reader/detector element 114 to uniquely relate to or otherwise identify different locations along the route.

In still another embodiment, the primary electronic identifier 104 may be an element configured to actively communicate with the portable electronic device 102 via, for example, Bluetooth communication or other methods.

Regardless of the specific technology utilized for the primary electronic identifier element 104 and the reader/detector element 114, the portable electronic device 102 is configured to communicate with the primary electronic identifier element 104 and automatically log such communication as evidence that the designated Location corresponding to the identifier element 104 on the route 136 has been visited by an officer or other person on patrol.

An officer making his or her round may therefore carry the hand held electronic device 102 along the route 136 (FIG. 3), and may scan the primary identifier 104 (e.g., a bar code in this example) at each of the Locations 0-7 designated along the route (i.e., the start/finish location 120 and the other locations 122, 124, 126, 128, 130, 132, and 134 in the route 136). The hand held electronic device 102 then electronically logs, as each identifier 104 at each designate Location along the route 134 is scanned, detected, or read and creates an electronic entry that that officer made it to the each of the designated Locations 0-7 in the route 136. When all of the identifiers 104 at each designate Location has been detected with the portable device 102, the system 100 can confirm that the entire route 136 has been completed. Such an electronic system 100, utilizing portable electronic devices 102 communicating with unique primary electronic identifiers 104, are highly beneficial in a number of aspects.

Because the person (e.g., correctional facility officer) physically carries the electronic device 102 along the route 136, the log entries are recorded on the portable device 102 and need not be compiled from electronic logs at different locations. The handheld device 102 eliminates any need to reconcile different logs from different devices at each designated Location to confirm the completion of a round. The handheld device 102 may also automatically generate reports of incomplete or missing rounds as described below. Simplified record keeping with automated detection features for missing or incomplete rounds is therefore enabled in a relatively low cost device 102, and also relatively low cost primary electronic identifiers 104.

Also, because the log entries are stored on the portable device 102 that the person or officer carries along the route 136, such a system 100 is less vulnerable to deceptive manipulation than certain types of known patrol round verification systems. In particular, different persons are generally precluded from scanning the primary electronic identifiers 104 along the designated Locations 0-7 in the route (e.g., the start/finish location 120 and the other locations 122, 124, 126, 128, 130, 132 and 132 in the route 136 of FIG. 3) to make it appear that a route has been completed because the electronic identifiers 104 at the designated Locations must be scanned with one of the devices 102 provided in order for the completion of the entire route to be confirmed, or for a portion of the route as designated to each officer to be confirmed. By strategically selecting the number of authorized log devices 102, and also the number of authorized persons to use the devices 102, opportunities for human deception by having different persons visit the designated Locations can be severely limited, if not eliminated, by the system 100.

Such verification systems involving primary electronic identifiers 104 and hand held devices 102 are still vulnerable to other kinds of manipulation, however, and in some ways may even be easier to fool than conventional systems such as those described above. As one example, in an embodiment wherein the primary electronic identifiers 104 are bar codes, a clever end run of the system 100 may be to take pictures of the bar codes at the various designate Locations along the route(s), print the pictures, and then scan the pictures instead of physically completing the route and scanning the bar codes at the various designated Locations along the route. To avoid such a result, and as a further safeguard, secondary electronic identifiers 106 are provided that require manual action by a person in order for the communication with the primary element 104 to be logged as confirmation that the corresponding location on the patrol route has been visited Therefore, contemplated embodiments of the system 100 include, in addition to the primary electronic identifier elements 104 described above, secondary identifier elements 106 that require active participation of an officer (or other person completing the patrol) in order for electronic confirmation of the visited location to be recorded on the system 100.

In one embodiment of the system 100, each secondary identifier element 106 is provided in the form of a token generator. For example, the token generator may display a numerical code of a given length (e.g., a four character code), sometimes referred to as an authentication code, which changes in pseud-random fashion upon the expiration of a predetermined time interval such as 60 seconds in one example. As such, when a dedicated Location in the route 136 is reached having a primary electronic identifier element 104, the officer may be required to enter, via the input element 116 (FIG. 2) of the portable electronic device 102, the authentication code being displayed on the token generator at that time. The portable electronic device 102, or alternatively the patrol supervision system 108 (FIG. 1), may determine whether the entered authentication code is valid or invalid for the specific designated Location and time of the visit.

In contemplated embodiments, the token generators used as the secondary identifier elements 106 may be small electronic devices that each display a sequence of numbers, utilized as the authentication code, that is unique to that specific device. As those in the art may appreciate, the setup process for each token generator 106 sets the starting numbers for the following sequences. Each token generator 106 is configured such that once the starting numbers are known, the numbers displayed in the future can be reliably predicted by software, but not easily predicted by a person viewing the token generator 106. The number sequencing software, and also the starting numbers for each of the token generators 106 can reside on the portable electronic device 102 so that the authentication codes entered at each of the designated Locations on the route can be validated upon entry of the authentication codes by the officer or other person. The number sequencing software may also reside on the patrol supervision system 108 and accordingly the authentication codes entered at each of the designated Locations on the route 136 (FIG. 3) can also be validated by the patrol supervision system 108.

Specifically, the entered authentication code can be compared to the code as determined from the number sequencing software for the token generator 106 at each designated Location on the route 136. If the entered authentication code matches the code as determined from the number sequencing software, the authentication code is considered valid. If the entered authentication code does not match the code as determined from the number sequencing software for the token generator 106 at each location on the route, the authentication code is considered invalid. The authentication codes are compared for validation one by one as the officer or other person arrives at each of the designated Locations 0-7 while completing the route 136.

While token generators 106 are described as providing authentication codes, other variations are possible. Alternative secondary identifier elements 106 such as alphanumeric codes and dynamic password schemes may be provided, for example, in lieu of token generators as described above. As long as the device 102 or the patrol supervision system 108 can predict the code supplied by the secondary identification element 106 for validation purposes, any type of device may be used for the identification element 106.

As still another example, graphics and symbolic representations may also be utilized as the secondary identifier elements 106. For example, the identification element 106 could display a symbol or picture, and the device 102 could display a group of symbols or pictures that the operator may select as corresponding to the one displayed. If the officer selects the symbol or picture being displayed by the identification element 106 at the time that each designated Location in the route 136 is visited, the officer's selection is considered valid and the visit to the Designated location could be confirmed by the system 100.

As still another example, colors could be displayed on the secondary identification element 106, with the officer entering the color into the device 102 for validation purposes. Colors may be displayed on the device 102 for the officer to make the selection, or the officer may enter the color in word form on the device 102. For example, when the identification element 106 displays a red color, the officer may enter the word "red" into the device 102 for validation purposes.

As another variation, a sound could be emitted from the secondary identification element 106, with the officer identifying the sound being generated at each of the designated Locations with the device 102 for validation purposes.

Regardless of the specific techniques utilized in the system 100, the point is that the officer (or other person completing the route) is made to interact with the device 102 to identify the state of the secondary identification element 106 that changes over time. Unless the officer is physically present at the designated Location, it will be difficult, if not impossible, for the officer to know the state of the identification element 106 at that Location. This is even more so when different types of identification elements 106 are utilized along the same route. As such, one designated Location may involve a four digit identification code while another designated Location may involve a six digit identification code, and while still another designated Location may involve a symbol or graphic as the secondary identification element.

Returning now to the token generator 106 and authentication code example, if an entered authentication code is not determined to be valid by the system 100, the electronic device 102 may prompt the officer to retry to enter the code being displayed on the token device 106 at the designated Location. If the authentication code is determined to be valid, the electronic device 102 may provide confirmation to the officer via an audio or visual prompt. When the system 100 receives a valid authentication code corresponding to the secondary identification element 106, and after reading, scanning or detecting the primary identifier element 104, the officer may proceed to the next designated Location on the route 136.

In certain embodiments, the device 102 may be configured to direct the officer (or other person completing the route) to the next designated Location and may display informational feedback to the officer. For example, the device 102 may display a map including the route 136 and directional assistance so that the officer may navigate to the next designated Location, which may be helpful to new officers or officers unfamiliar with a particular patrol. Officers may also be provided with summary information such as the number of designated Locations in the route 136 (or a portion of the route assigned to the officer), the number of designated Locations that have been confirmed, the number of designated Locations remaining, elapsed time of the patrol, or an expected time to the next designated Location. The device 102 may also be used interactively to complete a patrol checklist as segments of the route 136 are completed. The officer may be prompted or reminded to look for certain things or to complete certain tasks on the patrol via the device 102, including but not limited to reading of the primary identification elements 104 and obtaining valid confirmations via the secondary identification elements 106.

In one embodiment, the validation of the authentication code via the secondary identifier elements 106 may be a condition precedent for communication between the portable device 102 and the primary electronic element 104 at the designated route Location visited. That is, the portable electronic device 102 in some embodiments may only enable communication with the primary electronic identifier element 104 after a valid authentication code displayed on the secondary identification element 106 has been entered. In other embodiments, the portable device 102 may communicate with the primary electronic identifier element 104 without a prior valid authentication code being received, but unless a valid identification code has also been entered, the system 100 will not indicate a confirmed visitation at the designated Location.

Using such techniques, it may be ensured that an officer or other person actually visits each designated Location in the route in a timely manner, because the authentication codes are only temporarily displayed at each location on the secondary identifier elements 106. That is, the secondary identifiers elements 106 are dynamic (i.e., changing over time) while the primary identifier elements 104 are static (i.e., fixed and constant over time). The presence of the primary and secondary identifiers 104, 106 distributed among the designated Locations of the routes of the system 100, both of which must be confirmed by the system 100, makes the system 100 much less vulnerable to deceptive manipulation.

If the officer or other person misses a designated Location in a route, such as the route 136, or one of the designated Locations along a portion of a route, the system 100 can automatically generate reminders to the officer or other person carrying the device 102, if not alarms and alerts to responsible personnel. Route data collected via the portable device 102 can be archived and detailed reports may be generated for troubleshooting of the system 100 as well as to evaluate officer performance in completing rounds. Administrative efficiency in overseeing the patrols and in detecting problems is enhanced significantly. Officer safety, or the personal safety of others, is also enhanced in a way that has not conventionally been possible or at least easily obtained.

Figure 4:
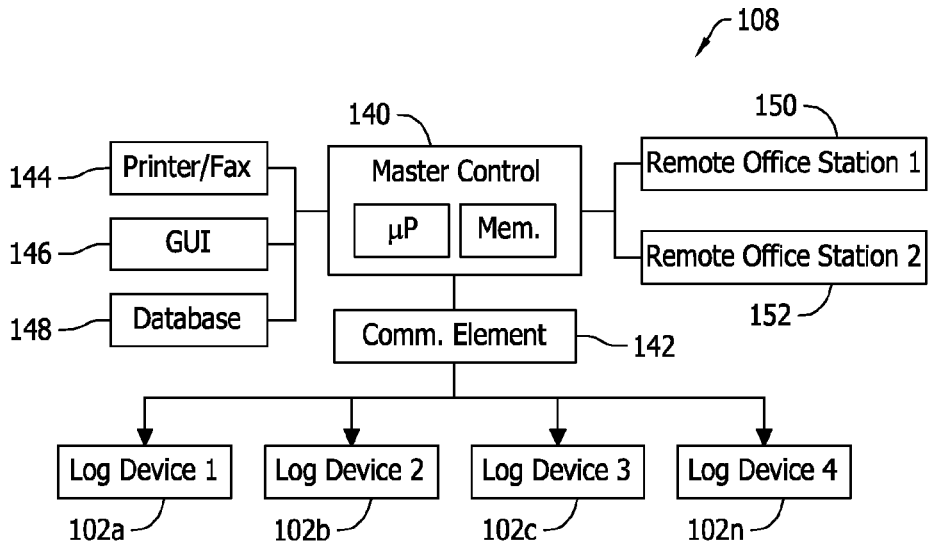
FIG. 4 illustrates an exemplary block diagram of the patrol supervision system shown in FIG. 1.

FIG. 4 illustrates an exemplary embodiment of the patrol supervision system 108 for the system 100 shown in FIGS. 1-3. The patrol supervision system 108 may include a processor-based master control element 140 interfaced with a communications element 142 facilitating bidirectional communication with a plurality of portable log devices 102. Any number n of portable devices 102 may be utilized.

The master control element 140 may also be interfaced with a printer/fax unit 144, a graphic user interface (GUI) 146 and a database 148. The master control element 140 may also be in communication with remote officer stations 150, 152. Each remote officer station 150, 152 may also include a graphic user interface (GUI). In contemplated embodiments, the master control element 140 and the remote officer stations may correspond to computer devices, and data collection, archiving of data, and alerts and alarms may be provided via software executed on the computer devices.

For example, using the data collected from the log devices 102, the system 100 may, via the patrol supervision system 108 or via the portable devices 102 themselves, compute average times to complete an entire route, average times to complete segments of a route, and other parameters useful for comparing performance of officers on patrol. Such data and computations can also be utilized in a predictive fashion to estimate expected times to traverse a segment of a route or an entire route at any given point in time. Such information can inure to much benefit of facility administrators as it may not only optimize assignment of routes to higher performing officers, but allow administrators to optimize the routes themselves. That is, based on the data collected by the system 100, routes can be made shorter or longer to better distribute the workload to officers and better utilize the resources of the correctional facility or other institution.

Additional degrees of safety and security for officers or others on patrol may also be realized when, for example, based on the data known to it, the system 100 may generate an alert when an officer (or other person on patrol) does not reach a particular identifier 104 or 106 at one of the designated Locations in the route within a predetermined period of time. For example, if the system 100 knows that the average time to traverse a segment of a route is five minutes, but ten minutes have elapsed without the officer (or other person) completing it, an alarm can be generated for assistance, or to prompt another person to at least attempt to communicate with the officer or other person on patrol to ascertain his or her condition and status. In user-based device scenarios, the officer or other person will log onto the device 102 and commence the route so the system 100 will know precisely which officer (or other person) is on patrol at any given moment, and also which of the officers or persons on patrol may require assistance or attention.

The system 100 is very flexible and adaptable to different facilities and changes to facility patrols over time. Primary and secondary electronic identifiers 104, 106 can be added, subtracted, and moved within the confines of the facility to modify the number of primary and secondary identifiers 104, 106 along each patrol route but also to create new routes. The system 100 is generally scalable to meet the needs of facilities large and small.

Figure 5:
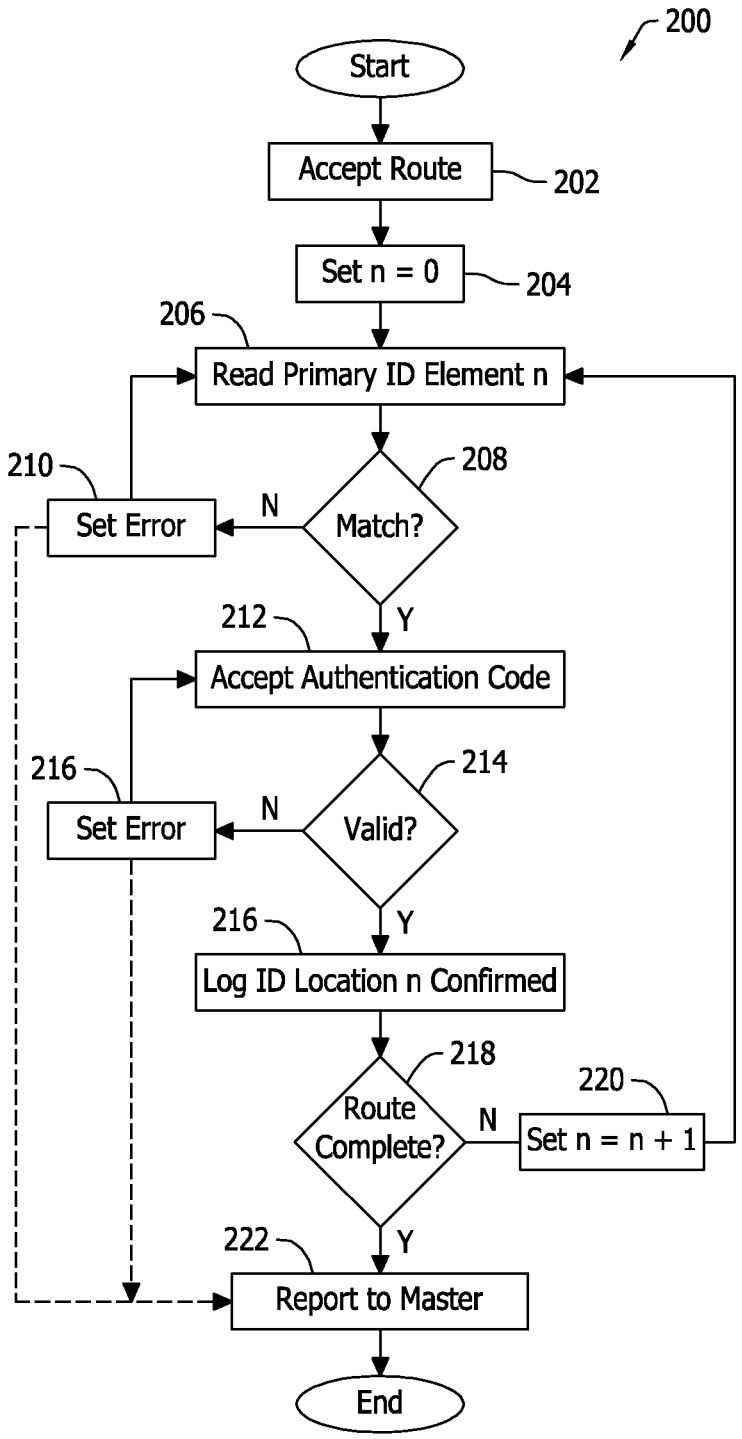
FIG. 5 is a flow chart of an exemplary method of verifying security patrol rounds with the portable electronic devices shown in FIGS. 1-3.

FIG. 5 illustrates exemplary method processes 200 performed by the processor-based portable log devices 102 of the system 100. The method processes may begin by accepting a route identifier 202 with the device 102. When the route is identified or selected, the device 102 may retrieve data from memory concerning the selected route, including but not limited to the number of designated Locations having the primary and secondary identifier elements 104, 106 and data relating to the identifiers 104, 106 at each of the designated Locations so that the system 100 may confirm the completion of the route, or a portion of the route. The route data may include the number of designated Locations in the route (including the start/finish locations) and identifying data for each of the designated Locations and the identifiers 104, 106 at each designated location.

At step 204, the device 102 sets n equal to zero as an initialization step. The officer (or other person on patrol) may now begin the route, and at step 206 may detect with the device 102 the first primary identifier 104 on the route, which may be at the start location.

At step 208, the device 102 determines whether the detected element corresponds to the first location on the selected route. In the case of the primary identifier being a unique two dimensional bar code relating to the location of the primary identifier element 104 being detected, the device 102 may perform the determination by matching the detected bar code with pertinent bar code information for the selected route at the location. Other variations are possible wherein the primary identifier element 104 is another machine readable element that communicates, actively or passively, with the device 102.

If at step 208 a match is not determined, the device 102 at step 210 sets an error and returns to step 206 where the officer may re-attempt to read the primary identifier 104 at the location.

If at step 208 a match is determined, the device 102 at step 212 proceeds to accept an authentication code or other identifier from the officer, which the officer obtains from the secondary identifier element 106 and enters into the device 102. Selections may be presented on the device 102 for the officer to enter the identifier presented by the secondary identifier element 106 at the location.

At step 214 if the entered authentication code (or other identifier) is determined to be invalid, the device at step 216 sets an error and returns to step 212 where the officer may re-attempt to enter the authentication code with the device 102.

If at step 214 the authentication code (or other identifier) is determined to be valid, the device 102 at step 216 proceeds to log a confirmation that the location has been visited by the officer or other person on patrol. The device 102 then proceeds to determine whether the route is complete at step 218 (i.e., the device 102 determines whether or not there are additional designated Locations along the route that need verification).

If at step 218 the route is not yet complete, at step 220 n is reset to n+1. The officer may proceed to the next Location and the device 102 returns to step 206 to read the primary identifier at the next Location if the route has a predetermined path, or to read the primary identifier at another Location if the route has a discretionary path wherein the designated locations may be visited in any order desired. The device 102 will cycle through steps 206, 208, 212, 214, 216, 218 and 220 until all the Locations on the route have been verified and the route is determined to be complete, or until a designated portion of the route is complete. The device 102 can then report at step 222 to the master control element 140 (FIG. 4) of the patrol supervision system 108. That is, the device 102 sends route completion and verification information to the patrol supervision 108 for further review. Varying levels of detail may be reported in various embodiments providing a range of sophistication to the system 100.

The reporting at step 222 may occur by wired or wireless means after the officer or other person on patrol completes the route or the portion of a route that the person has been assigned. In a wireless embodiment, the device 222 may send the report from any location. In a wired embodiment, the officer would need to bring the device 102 to a reporting station where the data can be transferred from the device 102 to the master control element 140. The data may be uploaded or scanned, for example, at the reporting station for data transfer purposes. A variety of different types of data transfer are possible at the reporting stations, however, and any of them may be used.

In still other adaptations of the method, the reporting of devices 102 can be made in more or less real time as each designated Location is visited and confirmed using the primary and secondary identification elements 104 and 106. That is, the confirmed designated Locations may be reported one by one as the officer or other person arrives at each designated Location in a patrol route rather than being reported as a group after the route is completed.

Also, as shown in FIG. 5, the device 102 may, when errors are detected at steps 210 and 216, immediately report to the master control element 140. In particular, if a route location is missed or if repeated authentication code errors are made, alerts can be generated practically in real time so that administrators can quickly direct appropriate attention to the matter. Such errors may be an indication of an attempt to manipulate the system 100, an officer or other person in need of assistance, or a malfunction in the system 100.

Errors and alert notifications generated by the system 100 may be made in any manner desired, including but not limited to audio and visual alarms, voicemail messages, text messages, facsimile transmission, or by other means in a substantially automated manner. Escalating alarms and notifications may also be implemented such that a first notification may be provided on the device 102 itself being carried by a person on patrol, or to other devices 102 being used by other officers also on patrol in the same or different routes. If such alarm or error notifications are not cleared in a predetermined time frame, the alarm or error notifications may be provided to others, including officers at remote officer stations 150, 152 (FIG. 4) or other facility administrators or responsible persons. The errors and alarms set and notifications generated may be archived on the system 100 for diagnostic purposes, troubleshooting purposes, or for performance evaluation of officers on patrol and other responders to the system 100.

Figure 6:
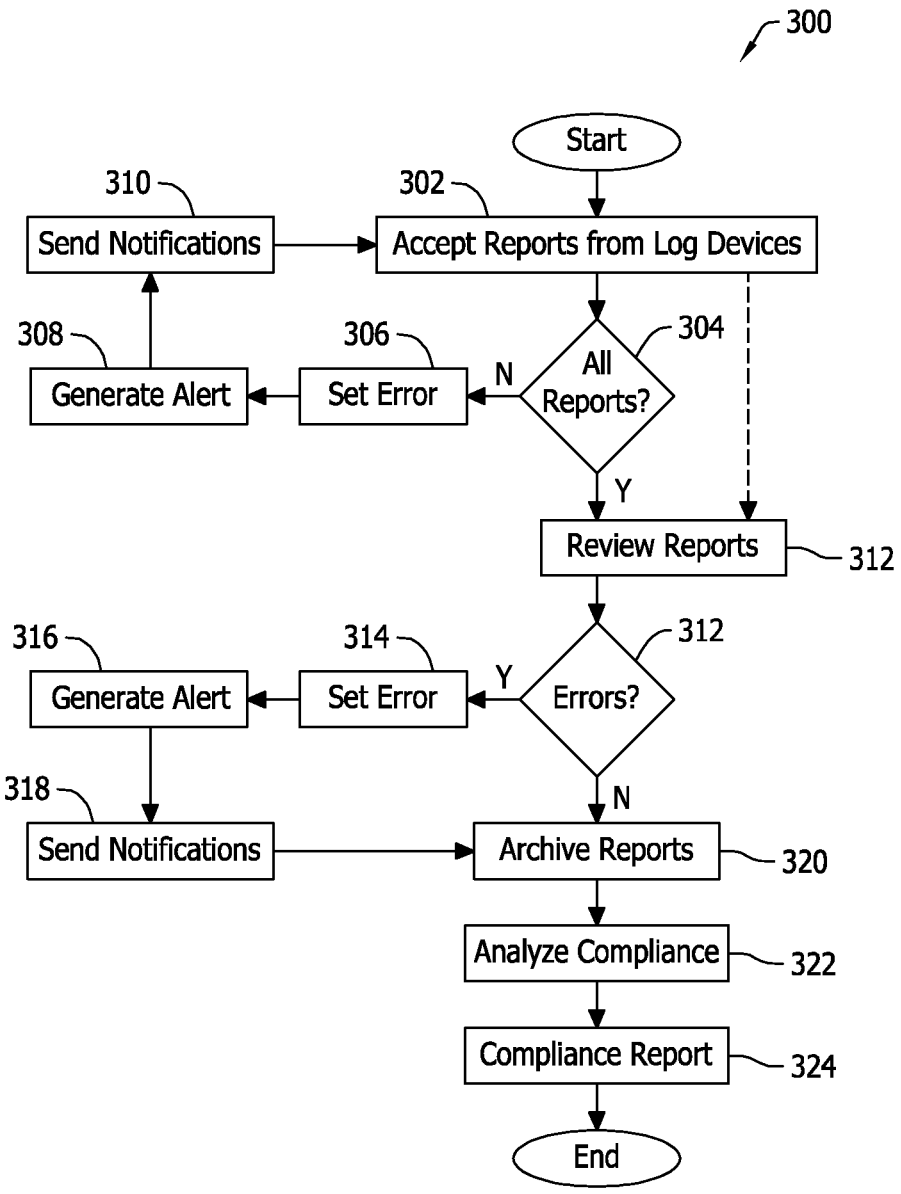
FIG. 6 is a flowchart of an exemplary method of evaluating compliance with applicable security patrol round procedures.

FIG. 6 illustrates exemplary method processes 300 executed by the patrol supervision system 108. At step 302 the patrol supervision system may accept reports from the portable log devices 102 regarding verification of designated Locations along patrol routes, and assess complete or incomplete route information as explained below as each device 102 is used.

At step 304, the patrol supervision system determines whether reports from all the portable devices 102 in use have been received. Thus, for example, if three officers perform three patrols on different routes using three devices 102 in a given timeframe the system 100 checks to see whether all three of the devices 102 have reported. If not, an error is set at step 306, an alert is generated at step 308 and a notification is sent at step 310. The notification may be sent to the non-reporting devices 102 as well as to other personnel. The system 100, and specifically the patrol supervision system 108, returns to step 302 and awaits further reports.

When all reports from the devices 102 are received, the system reviews the reports at step 312 to determine if the reports include errors such as incomplete routes or missing route segments. If errors are detected an error is set at step 314, an alert is generated at step 316 and a notification is sent at step 318. The notification may be sent to one or more of the devices 102 as well as to other personnel.

At step 320 the reports are archived and at step 322 compliance issues in completing security patrols are analyzed. A wealth of information may be analyzed in relation to analyzing compliance. For example, it can be readily confirmed not only whether or not periodic security patrols have been completed, but when they were completed, how fast they were completed, which officers completed them, any errors that occurred as routes were completed, etc. Detailed reports 324 may be provided at step 324 including any information of interest to facility overseers and management personnel.

It is recognized that in certain embodiments the functionality of the portable devices 102 and the patrol supervision system 108 could be combined into a single device.

Having now described the system functionally, it is believed that those in the art could program the system with appropriate algorithms and controls to execute the functionality described.

The technical effect of the processes and systems described herein is achieved when data and information pertaining to security patrol routes and their corresponding identifiers 104, 106 is entered, transmitted, downloaded or otherwise accepted by the system 100 in the devices 102 or the patrol supervision system 108. The data and information used by the system 100 may be supplied and accepted through any of the electronic, processor-based devices described above, or may be supplied from other sources if desired.

The systems and processes of the invention are not limited to the specific embodiments described herein. Components of each system and each process can be practiced independent and separate from other components and processes described herein. Each component and process also can be used in combination with other components, systems and processes. Varying degrees of complexity and functionality may be provided for cost management reasons and to meet the needs of particular users. It should now be apparent that the system components and functionality may be mixed and matched to generate varying systems which obtain the benefits of the present invention to varying degrees.

The system and methods described are versatile and flexible to suit the needs of many institutions, correctional facilities, and situations. The systems and methods may operate for patrol routes having predetermined paths and discretionary paths, and may work effectively with multiple officers and multiple patrol routes. The system and methods are rather intuitive and user friendly, and may be installed at maintained at relative low cost. The systems and methods are also readily adaptable to changes, and may be easily modified to meet changing needs of any particular facility.

The advantages of the inventive concepts disclosed are now believed to be evident in view of the exemplary embodiments disclosed.

An embodiment of a system for verifying compliance of persons completing a security patrol route for an institutional facility that houses residents in a controlled environment has been disclosed. The system includes: at least one machine readable, primary electronic identifier located at a designated location along the security patrol route of the institutional facility; and at least one portable, processor-based log device movable by a person completing at least a portion of the security patrol route of the institutional facility; wherein the at least one portable, processor-based log device and the at least one machine readable, primary electronic identifier are configured to communicate to confirm the person's presence at the designated location.

Optionally, the at least one portable, processor-based log device may include a reader/detector element configured to communicate with the at least one machine readable, primary electronic identifier at the designated location. The at least one machine readable, primary electronic identifier may include a bar code. The at least one machine readable, primary electronic identifier may be a static element. The at least one machine readable, primary electronic identifier may be an active element.

Optionally, the at least one machine readable, primary electronic identifier may include a plurality of machine readable, primary electronic identifiers at different designated locations along the security patrol route of the institutional facility, and each of the plurality of machine readable, primary electronic identifiers may uniquely identify the respective one of the different designated locations along the security patrol route of the institutional facility.

The system may also include at least one secondary identification element at the designated location along the security patrol route of the institutional facility, and the secondary identification element may be configured to present an identifier for the person to confirm using the at least one portable, processor-based log device. The at least one secondary identification element may be a dynamic element. The identifier may be at least one of an authentication code, a graphic, a symbol, a color, and a sound. The at least one portable, processor-based log device may include an input element configured for the person to enter or accept the identifier. The at least one portable, processor-based log device may be configured to determine whether the entered or accepted identifier is valid or invalid for the designated location. The at least one secondary identification element may include a token generator. The at least one secondary identification element and the at least one machine readable, primary electronic identifier may be arranged as a pair at the designated location along the security patrol route of the institutional facility. The at least one secondary identification element may include a plurality of secondary identification elements at different designated locations along the security patrol route in the institutional facility. When the person does not confirm the identifier in a predetermined period of time, an alert is generated.

The system may also optionally include a patrol supervision element remotely located from the designated location, and at least one of the portable, processor-based log device and the patrol supervision element may be configured to analyze compliance issues of completing at least a portion of the security patrol route by the person. At least one of the portable, processor-based log device and the patrol supervision element may be configured to generate at least one of a notification and an alert regarding non-compliance in completing at least a portion of the at least one patrol route by the person.

As another option, the at least one portable, processor-based log device may be configured to display informational feedback to the person. The informational feedback may include at least one of: a direction to a next designated location in the route, a display of a map including the route, a number of designated locations in the portion of the route, the number of designated locations in the route that have been confirmed, the number of designated locations remaining, an elapsed time of the patrol, an expected time to the next designated location, or a display of a patrol checklist.

Optionally, wherein when the person's presence at the designated location is not communicated in a predetermined period of time, an alert is generated. The security patrol may be defined by a predetermined path, and the designated location may be situated along the predetermined path. The security patrol route may be defined by one of a correctional facility, a hospital, a convalescent home, a long term care facility, a nursing home, a psychiatric facility, a rehabilitation facility and a developmental disability facility.

Another system for verifying compliance in completing a security patrol route for an institutional facility has also been disclosed. The system includes: a plurality of machine readable, primary electronic identifiers located at a plurality of designated location along the security patrol route in the institutional facility; a plurality of secondary identification elements located at a plurality of designated location along the security patrol route in the institutional facility; and at least one portable, processor-based log device movable by a person completing at least a portion of the security patrol route in the institutional facility; wherein the at least one portable, processor-based log device and the plurality of machine readable, primary electronic identifiers are configured to communicate to confirm the person's presence at their respective designated locations; and each of the secondary identification elements being configured to present an identifier for the person to confirm using the at least one portable, processor-based log device.

Optionally, the plurality of machine readable, primary electronic identifiers and the plurality of secondary identification elements are provided as pairs at each of the designated locations. In each pair of machine readable, primary electronic identifier element and secondary identification element, one of the machine readable, primary electronic identifier element is a static element and the other of machine readable, primary electronic identifier element and secondary identification element is a dynamic element. The identifier may be at least one of an authentication code, a graphic, a symbol, a color, and a sound. The at least one portable, processor-based log device may include an input element configured for the person to enter or accept the identifier. The at least one portable, processor-based log device may be configured to determine whether the entered or accepted identifier is valid or invalid for the designated location. Each of the plurality of machine readable, primary electronic identifiers may uniquely identifies the respective one of the different designated locations along the security patrol route in the institutional facility. When the person's presence is not confirmed in a predetermined period of time, an alert may be generated. The at least one portable, processor-based log device may include a reader/detector element configured to communicate with the plurality of machine readable, primary electronic identifiers at their respective designated locations. At least one of the plurality of machine readable, primary electronic identifiers at their respective designated locations may be a bar code. The institutional facility may be a correctional facility, and the system may further include a patrol supervision element. The at least one portable, processor-based log device may be configured to communicate with the patrol supervision system in the correction facility.

A method for verifying compliance in completing a security patrol route for an institutional facility that houses residents in a controlled environment has also been disclosed. The method is implemented with at least one machine readable, primary electronic identifier located at a designated location along the security patrol route in the institutional facility and at least one portable, processor-based log device movable by a person completing at least a portion of the security patrol route in the institutional facility. the method includes: confirming the person's presence at the designated location via communication between the at least one portable, processor-based log device and the at least one machine readable, primary electronic identifier at the designated location.

Optionally, the method may be further implemented with at least one secondary identification element configured to present an identifier to the person at the designated location, and the method further may include: accepting, with the at least one portable, processor-based log device, an input from the person corresponding to the identifier presented. The method may also include determining if the accepted input is valid or invalid for the designated location. The method may further include generating at least one of a notice and an alert regarding an incomplete route. The method may also include generating a safety alert if the person's presence is not confirmed in a predetermined time.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for verifying compliance of persons completing a security patrol route for an institutional facility that houses residents in a controlled environment, the system comprising:

at least one machine readable, primary electronic identifier located at a designated location along the security patrol route of the institutional facility; and at least one portable, processor-based log device movable by a person completing at least a portion of the security patrol route of the institutional facility;

wherein the at least one portable, processor-based log device and the at least one machine readable, primary electronic identifier are configured to communicate to confirm the person's presence at the designated location; and at least one secondary identification element at the designated location along the security patrol route of the institutional facility, the secondary identification element configured to present an identifier for the person to confirm using the at least one portable, processor-based log device.

2. The system of claim 1, wherein the at least one portable, processor-based log device includes a reader/detector element configured to communicate with the at least one machine readable, primary electronic identifier at the designated location.

3. The system of claim 2, wherein the at least one machine readable, primary electronic identifier comprises a bar code.

4. The system of claim 1, wherein the at least one machine readable, primary electronic identifier is a static element.

5. The system of claim 1, wherein the at least one machine readable, primary electronic identifier is an active element.

6. The system of claim 1, wherein the at least one machine readable, primary electronic identifier comprises a plurality of machine readable, primary electronic identifiers at different designated locations along the security patrol route of the institutional facility, and wherein each of the plurality of machine readable, primary electronic identifiers uniquely identifies the respective one of the different designated locations along the security patrol route of the institutional facility.

7. The system of claim 1, wherein the at least one secondary identification element is a dynamic element.

8. The system of claim 1, wherein the identifier is at least one of an authentication code, a graphic, a symbol, a color, or a sound.

9. The system of claim 1, wherein the at least one portable, processor-based log device includes an input element configured for the person to enter or accept the identifier.

10. The system of claim 9, wherein the at least one portable, processor-based log device is configured to determine whether the entered or accepted identifier is valid or invalid for the designated location.

11. The system of claim 1, wherein the at least one secondary identification element comprises a token generator.

12. The system of claim 1, wherein the at least one secondary identification element and the at least one machine readable, primary electronic identifier are arranged as a pair at the designated location along the security patrol route of the institutional facility.

13. The system of claim 1, wherein the at least one secondary identification element comprises a plurality of secondary identification elements at different designated locations along the security patrol route in the institutional facility.

14. The system of claim 1, wherein when the person does not confirm the identifier in a predetermined period of time, an alert is generated.

15. The system of claim 1, further comprising a patrol supervision element remotely located from the designated location, and wherein at least one of the portable, processor-based log device and the patrol supervision element is configured to analyze compliance issues of completing at least a portion of the security patrol route by the person.

16. The system of claim 15, wherein at least one of the portable, processor-based log device and the patrol supervision element is configured to generate at least one of a notification and an alert regarding non-compliance in completing at least a portion of the at least one patrol route by the person.

17. The system of claim 1, wherein the at least one portable, processor-based log device is configured to display informational feedback to the person.

18. The system of claim 17, wherein the informational feedback includes at least one of: a direction to a next designated location in the route, a display of a map including the route, a number of designated locations in the portion of the route, the number of designated locations in the route that have been confirmed, the number of designated locations remaining, an elapsed time of the patrol, an expected time to the next designated location, or a display of a patrol checklist.

19. The system of claim 1, wherein when the person's presence at the designated location is not communicated in a predetermined period of time, an alert is generated.

20. The system of claim 1, wherein the security patrol route is defined by a predetermined path, and the designated location is situated along the predetermined path.

21. The system of claim 20, wherein the security patrol route is defined by one of a correctional facility, a hospital, a convalescent home, a long term care facility, a nursing home, a psychiatric facility, a rehabilitation facility and a developmental disability facility.

22. A system for verifying compliance in completing a security patrol route for an institutional facility, the system comprising:

a plurality of machine readable, primary electronic identifiers located at a plurality of designated location along the security patrol route in the institutional facility;

a plurality of secondary identification elements located at a plurality of designated location along the security patrol route in the institutional facility; and at least one portable, processor-based log device movable by a person completing at least a portion of the security patrol route in the institutional facility;

wherein the at least one portable, processor-based log device and the plurality of machine readable, primary electronic identifiers are configured to communicate to confirm the person's presence at their respective designated locations; and each of the secondary identification elements being configured to present an identifier for the person to confirm using the at least one portable, processor-based log device.

23. The system of claim 22, wherein the plurality of machine readable, primary electronic identifiers and the plurality of secondary identification elements are provided as pairs at each of the designated locations.

24. The system of claim 23, wherein in each pair of machine readable, primary electronic identifier element and secondary identification element, one of the machine readable, primary electronic identifier element is a static element and the other of machine readable, primary electronic identifier element and secondary identification element is a dynamic element.

25. The system of claim 22, wherein the identifier is at least one of an authentication code, a graphic, a symbol, a color, and a sound.

26. The system of claim 22, wherein the at least one portable, processor-based log device includes an input element configured for the person to enter or accept the identifier.

27. The system of claim 26, wherein the at least one portable, processor-based log device is configured to determine whether the entered or accepted identifier is valid or invalid for the designated location.

28. The system of claim 22, wherein each of the plurality of machine readable, primary electronic identifiers uniquely identifies the respective one of the different designated locations along the security patrol route in the institutional facility.

29. The system of claim 22, wherein when the person's presence is not confirmed in a predetermined period of time, an alert is generated.

30. The system of claim 22, wherein the at least one portable, processor-based log device includes a reader/detector element configured to communicate with the plurality of machine readable, primary electronic identifiers at their respective designated locations.

31. The system of claim 22, wherein at least one of the plurality of machine readable, primary electronic identifiers at their respective designated locations comprises a bar code.

32. The system of claim 22, wherein the institutional facility is a correctional facility, wherein the system further comprises a patrol supervision element, and wherein the at least one portable, processor-based log device is configured to communicate with the patrol supervision system in the correction facility.

33. A method for verifying compliance in completing a security patrol route for an institutional facility that houses residents in a controlled environment, the method implemented with at least one machine readable, primary electronic identifier located at a designated location along the security patrol route in the institutional facility, at least one secondary identification element configured to present an identifier to a person at the designated location, and at least one portable, processor-based log device movable by the person completing at least a portion of the security patrol route in the institutional facility; the method comprising:

confirming the person's presence at the designated location via communication between the at least one portable, processor-based log device and the at least one machine readable, primary electronic identifier at the designated location; and accepting, with the at least one portable, processor-based log device, an input from the person corresponding to the identifier presented.

34. The method of claim 33, further comprising determining if the accepted input is valid or invalid for the designated location.

35. The method of claim 33, further comprising generating at least one of a notice and an alert regarding an incomplete route.

36. The method of claim 33, further comprising generating a safety alert if the person's presence is not confirmed in a predetermined time.

37. A system for verifying compliance of persons completing a security patrol route for an institutional facility that houses residents in a controlled environment, the system comprising:

at least one machine readable, primary electronic identifier located at a designated location along the security patrol route of the institutional facility; and at least one portable, processor-based log device movable by a person completing at least a portion of the security patrol route of the institutional facility;

wherein the at least one portable, processor-based log device and the at least one machine readable, primary electronic identifier are configured to communicate to confirm the person's presence at the designated location;

wherein the at least one portable, processor-based log device is configured to display informational feedback to the person; and wherein the informational feedback includes at least one of: a direction to a next designated location in the route, a display of a map including the route, a number of designated locations in the portion of the route, the number of designated locations in the route that have been confirmed, the number of designated locations remaining, an elapsed time of the patrol, an expected time to the next designated location, or a display of a patrol checklist.

38. The system of claim 37, wherein the at least one machine readable, primary electronic identifier comprises a plurality of machine readable, primary electronic identifiers at different designated locations along the security patrol route of the institutional facility, and wherein each of the plurality of machine readable, primary electronic identifiers uniquely identifies the respective one of the different designated locations along the security patrol route of the institutional facility.

39. The system of claim 37, further comprising a plurality of secondary identification elements at different designated locations along the security patrol route of the institutional facility, wherein each of the secondary identification elements is configured to present an identifier for the person to confirm using the at least one portable, processor-based log device.

40. The system of claim 39, wherein the at least one secondary identification element and the at least one machine readable, primary electronic identifier are arranged as a pair at different designated locations along the security patrol route of the institutional facility.

41. The system of claim 39, wherein the identifier is at least one of an authentication code, a graphic, a symbol, a color, or a sound.

42. The system of claim 39, wherein the at least one portable, processor-based log device includes an input element configured for the person to enter or accept the identifier at each one of the different designated locations along the security patrol route of the institutional facility.

43. The system of claim 42, wherein the at least one portable, processor-based log device is configured to determine whether the entered or accepted identifier is valid or invalid for each one of the different designated locations along the security patrol route of the institutional facility.

44. The system of claim 39, wherein when the person does not confirm the identifier in a predetermined period of time, an alert is generated.

45. The system of claim 37, wherein the security patrol route is defined by a predetermined path, and the designated location is situated along the predetermined path.

46. The system of claim 45, wherein the security patrol route is defined by one of a correctional facility, a hospital, a convalescent home, a long term care facility, a nursing home, a psychiatric facility, a rehabilitation facility and a developmental disability facility.

* * * * *